US005979068A

United States Patent [19]

Andrews

[11] Patent Number: 5,979,068

[45] Date of Patent: Nov. 9, 1999

[54] SPRINKLER HEAD LOCATION GUIDE

[76] Inventor: Corley Andrews, 28613 Victoria Rd., Castaic, Calif. 91384

[21] Appl. No.: 08/862,729

[22] Filed: May 23, 1997

Related U.S. Application Data

[60] Provisional application No. 60/018,838, May 31, 1996.

[51] Int. Cl.[6] ..... G01D 21/00

[52] U.S. Cl. ..... 33/520; 33/644; 33/670; 33/671

[58] Field of Search ..... 33/520, 452, 456, 33/526, 527, 528, 533, 613, 644, 645, 670, 671, 673

[56] References Cited

U.S. PATENT DOCUMENTS

| | | | |
|---|---|---|---|
| 152,487 | 6/1874 | Hawley | 33/520 |
| 3,628,253 | 12/1971 | Shepard | 33/520 |
| 4,084,325 | 4/1978 | Jones, Jr. | 33/670 |

FOREIGN PATENT DOCUMENTS

| | | | |
|---|---|---|---|
| 44028 | 2/1988 | Japan | 33/520 |

*Primary Examiner*—Christopher W. Fulton
*Attorney, Agent, or Firm*—John E. Wagner

[57] ABSTRACT

A gauge is disclosed to grid in the location of sprinkler lines above grid type suspended ceilings. The gauge is used after the grid is installed but before the overhead sprinkler system is completed and before the ceiling tiles are installed. The gauge includes a plurality of arms, preferably three which have lengths approximating ½ of the grid opening dimension and are all pivotal and extendable, if necessary to engage the grid system and locate a central body to which the arms are secured. When extended, the arms define the center of the grid opening. An extendable arm is secured to the central body and may be manually extended upward to locate the center of the grid opening at the structural support for the sprinkler distribution system. A drop branch line from the distribution system at the location identified by the gauge is installed and a sprinkler head attached to the drop branch line. The sprinkler head will then be located at the center of a grid opening for proper aesthetics in the finished room.

10 Claims, 3 Drawing Sheets

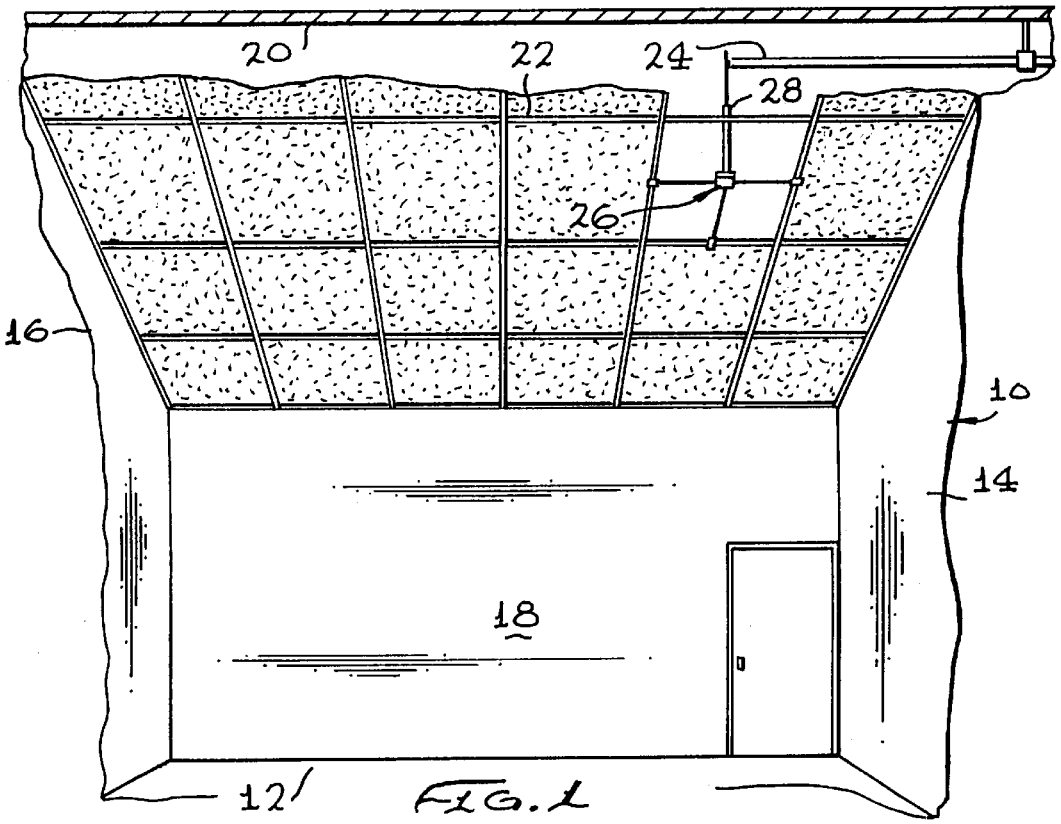
FIG. 1
FIG. 2
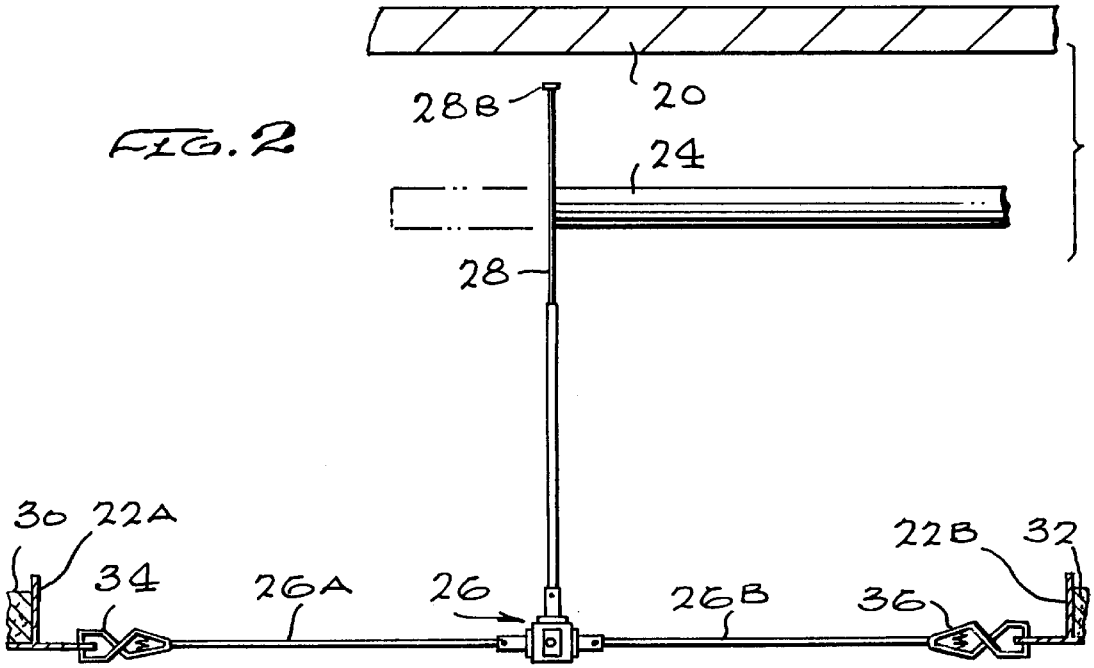

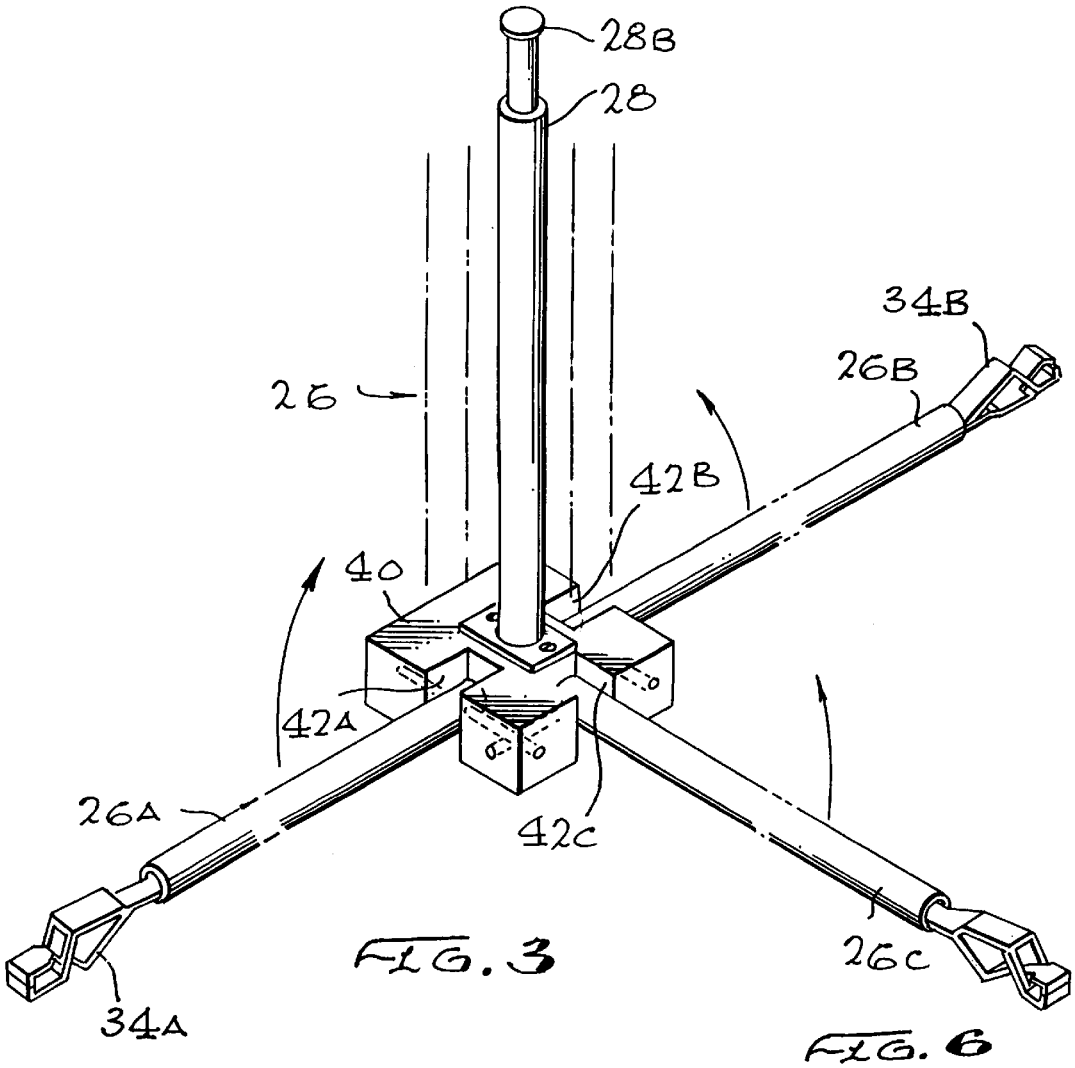
FIG. 3
FIG. 6
FIG. 5
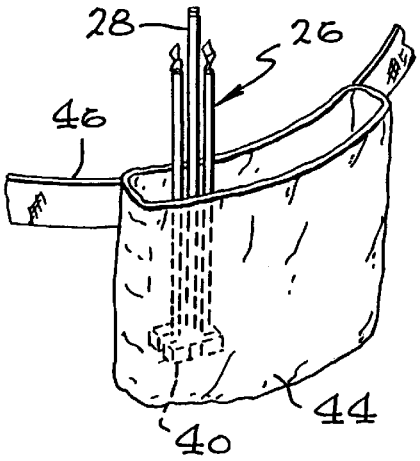
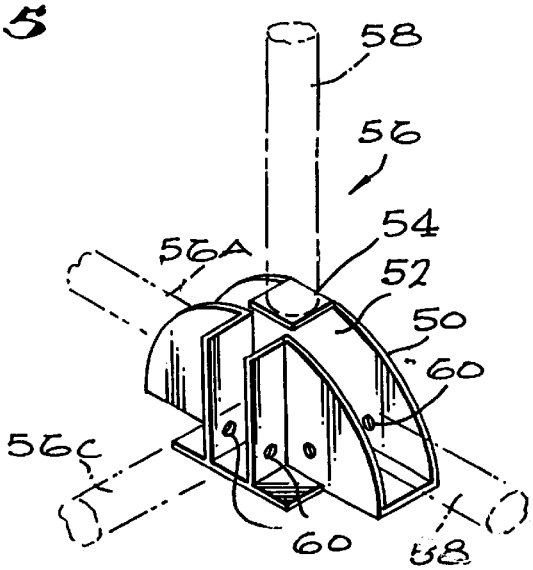

SPRINKLER HEAD LOCATION GUIDE

This application claims the benefit of U.S. Provisional Application(s) No(s).: Application Ser. No(s).: 60/018,838 filing date May 31, 1996.

BACKGROUND OF THE INVENTION

The development of the fire sprinkler system many years ago has made a major impact upon the minimization of damage to the structure and contents of buildings which are so protected. The classic fire sprinkler system includes a distribution system of piping secured to a ceiling with downward extending stub lines which support an individual sprinkler head. The sprinkler heads are usually fire or temperature responsive to melt a fusible link and release a shower of water to the protected space below. Typically these sprinkler heads are located a fixed distance apart to provide area coverage without fail.

In the case of installations in warehouses and factories, the sprinkler heads and piping are fully exposed since aesthetics are not usually a consideration. However, in the cases of retail establishments, offices and residential locations, it is desired that the fire sprinklers blend in with the ceiling as much as possible while maintaining its full operating capacity.

It has been proposed that adjustable mounts be provided for sprinkler heads to make them virtually flush and adjustable to be integrated in a suspended or false ceiling. An example of such a system is disclosed in U.S. Pat. No. 4,785,887 issued Nov. 22, 1988 to Peter Miller of Arlington, Va. and assigned on its face to Lifesaving Systems, Inc.

It has also been proposed that such a fire prevention system be integrated into the grid system of a suspended or false ceiling with sprinkler heads located at grid intersections. Such a system adds to the cost of the grid system and makes them integrated. Any change in the ceiling grid system will affect the sprinkler system. Such a system is disclosed in U.S. Pat. No. 4,791,993 issued on Dec. 20, 1988 to Jeremiah M. Curran of Yardley, Pa.

Where it is desired to mount a fire sprinkler system in a suspended ceiling employing, for example, a 2 foot by 2 foot grid system, it is desirable to have the sprinkler heads located at the center of a grid opening and therefore be symmetrically placed in the room. With common 10 foot spacing of sprinkler heads, this is possible, provided the distribution piping which is mounted on the structural ceiling is properly located with joints for stub or drop lines located directly at the center of every fifth grid.

In the past this has been accomplished by installing the ceiling grid first and then the pipefitter locating the fire sprinkler distribution system above the grid. One difficult task has been to locate the stub line at the precise center of a grid opening. Sometimes this is done by eye by the pipefitter or in some cases he has resorted to making a crude T guide from three straight arms, each of 1 foot length to provide a reference center point and then use a plumb bob, moving the line at the structural ceiling until the bob is over the intersection of the T and then mark the structural ceiling as a joint location. To avoid "drifting" of the distribution line with respect to the ceiling grid system, the same measurement must be taken at each grid opening which will have a sprinkler head. After the job is finished the T tool is usually discarded and the plumb bob returned to the pipefitter's tool box for the next job.

A jig for assisting the location of a sprinkler head and marking the ceiling tiles for cutting is disclosed in U.S. Pat. No. 4,928,773 issued on May 29, 1990 to Jerry H. White of San Juan Capistrano, Calif. Another system for adjusting fire sprinklers vertically in suspended ceilings is disclosed in U.S. Pat. No. 4,834,186 to E. A. Ballard of Scottsdale, Ariz.

Other general purpose jigs and templates for piping and other applications are disclosed in the following U.S. Patents:

| | | |
|---|---|---|
| 152,487 | G. F. Hawley | June 30, 1874 |
| 375,795 | J. Beyerle | Jan. 3, 1888 |
| 2,431,100 | J. A. Woods | Nov. 18, 1947 |
| 3,407,509 | J. S. Martinez | Oct. 29, 1968 |

BRIEF DESCRIPTION OF THE INVENTION

Faced with the continuing need to aid pipefitters to accurately and easily locate sprinkler head locations with respect to ceiling grids, I have devised a folding tool which is adjustable in four directions and two planes to hold the position for marking or direct installation of the piping with the tool or gauge in place. It includes a block or central connector to which three lateral arms are pivoted into one plane to define the distances from opposite sides and one end of a grid opening. When a 2 foot by 2 foot opening grid is used, two of the arms on opposite sides of the gauge are extendable approximately one foot to center the gauge and the other arm is adjustable to at least one foot distance in order to define the center point of the grid opening. The arms include ends which engage the grid lip and are of sufficient strength to hold the gauge in place. A fourth arm or telescoping rod is extended orthogonally with respect to the three arms to contact the structural ceiling and thereby to identify the location for the T joint of the piping distribution system and to locate the correct spot for the downward extending stub line which terminates in the fire sprinkler head. The four arms are pivotal into alignment when not in use for easy storage.

In one embodiment of this invention, the three arms which extend in the plane of the ceiling grid are telescoping and include alligator type clips to engage the adjacent lips of the grid system. In another embodiment, only the upward extending arm is telescoping and the remaining arms are of fixed length such as one foot.

In a third embodiment the body of the gauge is made of sheet metal and the end clips are formed to provide a recess for receiving the grid lip without a clamping engagement but securely holding the gauge in place while the measurement step is performed.

A further and preferred embodiment includes a rigid body with spring clips located in each of three slots to provide spring loading of each of the grid engaging arms.

One additional embodiment provides proper gauging while employing only two arms to engage the grid and one fixed but telescoping arm or rod to locate or mark the sprinkler head located on the structural ceiling. dr

BRIEF DESCRIPTION OF THE DRAWINGS

This invention may be more clearly understood with the following detailed description and by reference to the drawings in which:

FIG. 1 is a perspective drawing of a room including three walls, a floor, a ceiling and a dropped ceiling with ceiling grids and panels and showing the guide of the invention installed to aid in locating a stub line for a sprinkler system;

FIG. 2 is an enlarged cross sectional view through a portion of the ceiling and dropped ceiling of FIG. 1 with spaced grids and with the guide in position to locate a position for a stub line on a sprinkler system pipe;

FIG. 3 is a perspective drawing of a sprinkler head location guide according to the invention;

FIG. 5 is a perspective view of a folded guide like that of FIG. 4 located in a carry pouch; and FIG. 6 is a perspective view of a base for a sheet metal gauge according to the invention with extending arms shown in phantom.

DETAILED DESCRIPTION OF THE INVENTION

Figure 3A:
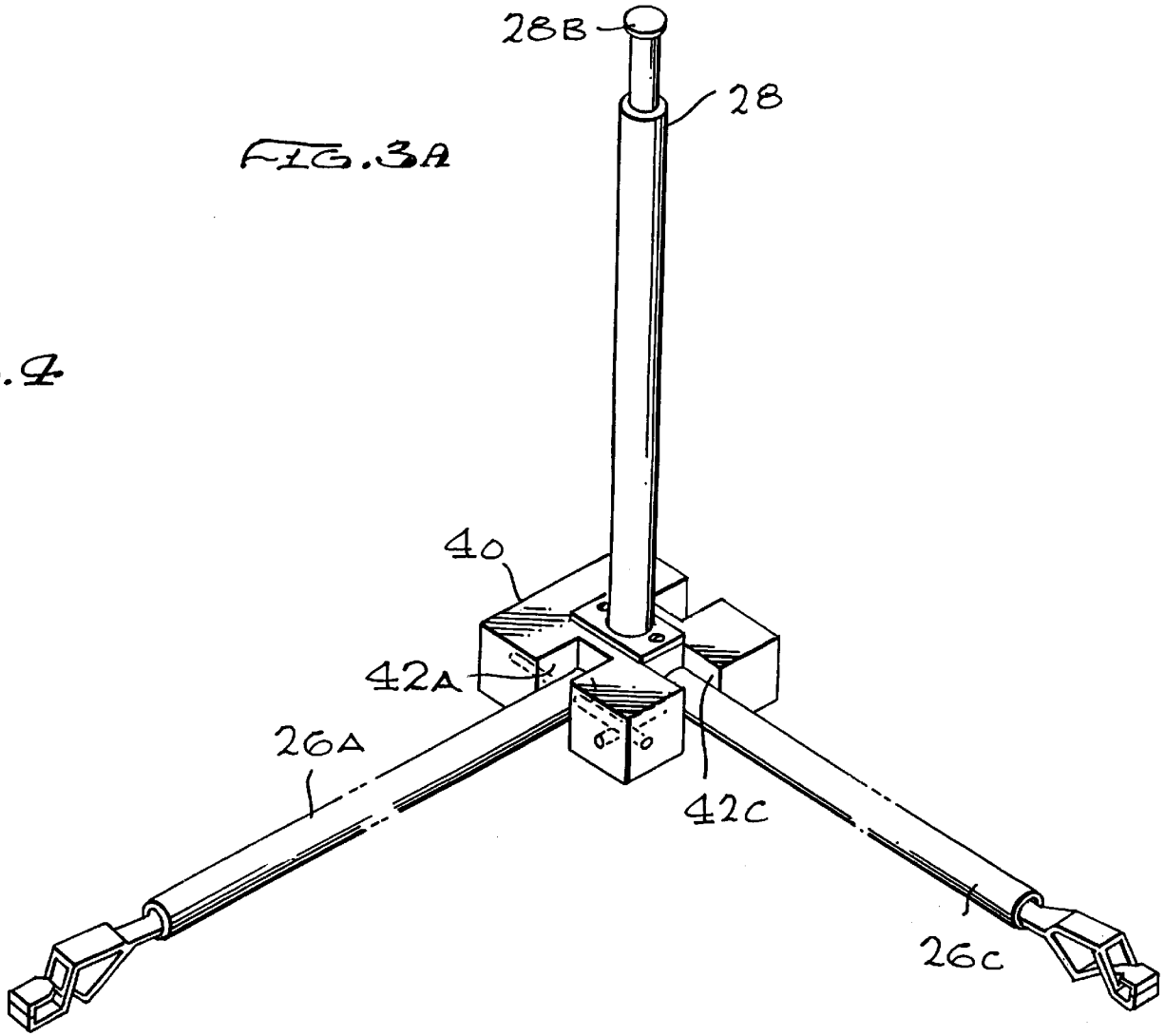
FIG. 3A is a perspective drawing of an alternate embodiment of this invention employing only two arms for engaging the ceiling grid and one sprinkler head position defining or marking.

Referring now to FIGS. 1 and 2, a room 10 is shown having a floor 12, sidewalls 14 and 16, an end wall 18 and a ceiling 20. Also suspended from the ceiling 20 is a grid 22 having, for example, 2 ft.×2 ft. ceiling openings for receiving ceiling panels. Suspended from the ceiling 20 is a water pipe 24 which is part of the sprinkler distribution system. In FIG. 1, a ceiling panel has been removed from grid 22 and the gauge 26 of the invention has been temporarily installed with outward extending legs attached to lip portions of the grid 22 and a telescoping rod 28 extending vertically to engage the pipe 24 to locate the T joint of the sprinkler system directly above the center of the grid opening in which gauge 26 is located.

FIG. 2 is a cross sectional drawing through a portion of the ceiling 20 and dropped ceiling with grid members 22A and 22B supporting ceiling panels 30 and 32. The gauge 26 is centered between and attached to grid members 22A and 22B by means of arms 26A and 26B and spring clamps 34, 36. At the center of gauge 26 is located a vertical rod 28 which may be telescoping and which extends upwardly sufficiently to contact pipe 24 to thereby locate a T joint for a stub or drop line to a sprinkler head to be located in the center of the missing ceiling panel. It will be apparent that a third arm of gauge 26 insures the centering of the gauge in one direction and the movement of the remaining arm into engagement with the adjoining grid precisely centers the gauge 20 in the plane of the ceiling grid and perpendicular to arms 26A, 26B and 26C, as shown in FIG. 1.

A slightly different embodiment of my invention is shown in FIG. 3. Parts which are identical or nearly so have been given the same numerals. FIG. 3 is a perspective drawing in which arms 26A, 26B, 26C and vertical rod 28 are shown attached to a mounting block 40 having a plurality of cut outs 42A, 42B and 42C in which arms 26A, 26B and 26C are located and pinned for rotational movement as indicated by the arrows. Vertical rod 28 is fixed to block 40 and arms 26A, 26B and 26C are rotatable to vertical positions essentially parallel to arm 28 for storage and carrying.

The rod 28 is shown in FIG. 3 as telescoping and with a top button 28B. This button may be merely a metal cap or may include a marking pen or device to leave a mark on the structural ceiling 20 of FIG. 1 at the location in vertical alignment with the desired sprinkler head location.

Figure 4:
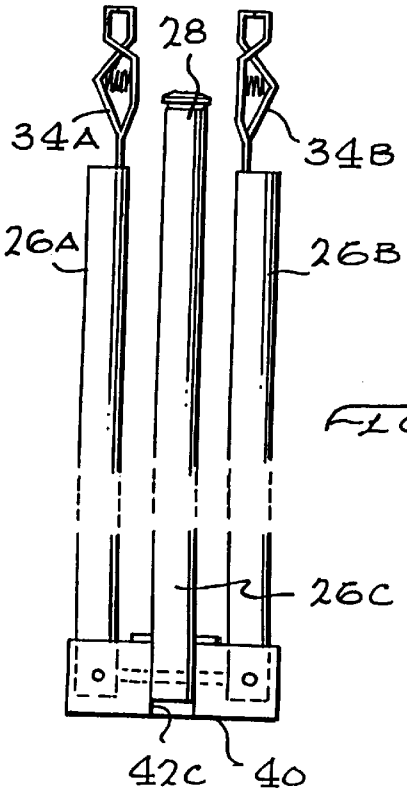
FIG. 4 is a side elevational view, partly in phantom, of the guide of FIG. 3 folded for transporting.

This embodiment is shown in folded configuration in FIG. 4 in which arms 26A, 26B and 26C are all rotated to a vertical position, i.e., parallel to rod 28. Arm 26C has been shown cut off to allow illustration of rod 28 which, in this view, is directly behind it. Each of arms 26A, 26B and 26C have a spring clamp such as clamps 34A and 34B at its outboard end. Other suitable kinds of clamps or attachment devices could be used depending on the configurations of the grid members 22A and 22B.

FIG. 5 shows the gauge 26 of FIGS. 3 and 4 folded and placed in a pouch 44 which is preferably carried on a belt 46.

It is recognized that these arms 26A, 26B and 26C positively position the gauge centered in the grid system. However, in its simplest form, as illustrated in FIG. 3A, another embodiment of my invention employs just two arms 26A and 26C at right angles to each other with length determined by the grid size, e.g., 2 foot grid, and approximately 1 foot arms. This embodiment also folds arms 26A and 26B parallel to rod 28 for convenient storage or carrying as illustrated in FIG. 5 for the 3 arm version. Such an arrangement can temporarily gauge the location of the center of the grid opening but tends not to be self supporting without rigid connections to intersecting grid members. Therefore, the three arm configuration of FIG. 3 is preferred.

Another embodiment of my gauge may be made from sheet metal as shown at numeral 56 in FIG. 6. The base portion 50 is of sheet metal such as aluminum and formed to the desired shape. A box section 52 in base 50 has a top opening 54 for receiving a hollow elongated arm 58 sized to fit therein. Other arms or arms 56A, 56B and 56C are pivotally attached to base 50 by means of suitable pins passing through bores 60 which permits arms 56A, 56B and 56C to pivot upwardly parallel to arm 58 similarly to the arrangement of FIG. 4.

The above described embodiments of the present invention are merely descriptive of its principles and are not to be considered limiting. The scope of the present invention instead shall be determined from the scope of the following claims including their equivalents.

I claim:

1. A gauge for the location of the centers of grid openings in a grid ceiling comprising:

a gauge body;

a plurality of arms extending from said gauge body, each of said arms having a length approximately one half of the dimensions of the grid openings of a ceiling grid system to be gauged for location of the grid center;

means secured to each of said arms for engaging the grid, at least two of said arms engaging adjacent sides of the grid at midpoints thereof whereby said gauge body is located generally at the center of the grid opening;

a rod secured to said gauge body orthogonal to said plurality of arms when said arms are in engagement with the grid;

at least one of said arms being foldable with respect to said body into alignment with said rod whereby said gauge may be stored when not in use.

2. A gauge in accordance with claim 1 wherein said rod is telescoping.

3. A gauge in accordance with claim 1 wherein said means for engaging the grid comprises at least one spring clip secured to the end of an arm.

4. A gauge in accordance with claim 1 wherein said plurality of arms includes three arms positionable in the plane of said grid with two of said three arms extending across the grid to engage opposite grid parts and the third arm engaging the center portion of a grid to place the body of said gauge generally at the center of the grid opening.

5. A gauge in accordance with claim 4 wherein said three arms are pivotally connected to said body.

6. A gauge in accordance with claim 5 wherein said three arms are pivotal to positions extending generally parallel to said rod when not in use.

7. A gauge in accordance with claim 6 wherein said body includes detent means for locking said arms in extended position for gauging and for locking said arms in closed position for storage and transport.

8. A gauge in accordance with claim 1 wherein said body includes grooves therein for locating said arms and pins engaging said arms for pivotal engagement with said body in said grooves.

9. A gauge in accordance with claim 1 wherein said rod includes marking means on the end thereof for marking the overhead at the center of each grid opening.

10. A gauge in accordance with claim 1 wherein said gauge body includes means supporting said arms such that when said arms are extended, one of said arms is substantially perpendicular to another said arm.

* * * * *